United States Patent [19]

Kent

[11] 4,211,458

[45] Jul. 8, 1980

[54] ZERO INSERTION FORCE CONNECTOR

[75] Inventor: William C. Kent, Garland, Tex.

[73] Assignee: Western Electric Company, Incorporated, New York, N.Y.

[21] Appl. No.: 35,175

[22] Filed: May 2, 1979

[51] Int. Cl.[3] ..... H01R 13/629

[52] U.S. Cl. ..... 339/74 R; 339/75 MP

[58] Field of Search ..... 339/74 R, 75 R, 75 M, 339/75 MP

[56] References Cited

U.S. PATENT DOCUMENTS

| | | | |
|---|---|---|---|
| 3,487,352 | 12/1969 | Putyato et al. | 339/75 M |
| 3,670,288 | 6/1972 | Evans | 339/74 R |
| 3,963,317 | 6/1976 | Eigenbrode et al. | 339/74 R |
| 4,047,782 | 9/1977 | Yeager | 339/75 MP |
| 4,068,170 | 1/1978 | Chayka et al. | 339/74 R |
| 4,072,379 | 2/1978 | Towne et al. | 339/74 R |
| 4,077,688 | 3/1978 | Cobaugh et al. | 339/74 R |
| 4,148,537 | 4/1979 | Sochor | 339/74 R |
| 4,153,948 | 5/1979 | Dimyan et al. | 365/28 |

*Primary Examiner*—John McQuade
*Attorney, Agent, or Firm*—R. P. Miller

[57] ABSTRACT

A zero force connector is constructed of a plurality of tiers of jack-like units (16, 17, 23 and 24) which are simultaneously opened and closed by turning a pair of screws made of sets (31 and 32). Each screw set has left and right-hand threads to cooperate with threaded ends (26,27) of the jack units so that all the jack-like units are moved to engage a plurality of tiers of plugs 10 with minimum sliding forces, thus, preventing abrading of precious metal plating on the contacting elements (13, 14, 18 and 19).

6 Claims, 4 Drawing Figures

ZERO INSERTION FORCE CONNECTOR

FIELD OF THE INVENTION

This invention relates to a zero insertion force connector, and more particularly to a connector having pairs of connector halves that may be simultaneously moved toward each other to engage contact elements formed on one or more plugs.

BACKGROUND OF THE INVENTION

In fabricating complex circuits such as utilized in the telecommunication industry, vast arrays of circuit modules are interconnected with plug and socket type connectors. In many instances these plugs and sockets contain contact elements that are plated with very thin layers of gold or other precious metals to insure the electrical integrity of the engaged contact elements which interconnect the circuit modules. Obviously, repetitive insertion and withdrawal of the plugs during initial assembly, testing and subsequent utilization, erodes the gold plated surfaces. These complex circuit installations also contemplate the utilization of circuit boards which are provided with edge terminal fingers or contact pads which are insertable in socket-like receptacles containing spring contact fingers which run to terminals to provide the interconnections with other circuit boards, modules and power sources. Again, it is desirable to provide connectors for these types of installations wherein the contact elements are subject to a minimum amount of wear.

In more complex circuit configurations, a plurality of tiers of plugs are engaged within banks of individual socket-like connectors. Prior to shipment of such equipment to an installation, such as a telephone exchange, it is necessary to test the various circuits in the factory. Again, in conducting these tests, wear of the precious metal contacts of the plug and sockets should be held to a minimum. Inasmuch as these types of plugs and sockets have multitudes of contacting surfaces, a considerable amount of physical force is required in order to insert and withdraw the plugs from the sockets.

In recent years, connectors known as zero insertion force connectors have been developed to alleviate some of the wear problems, and reduce the amount of physical force required to assemble the connector plugs and sockets in operative relation. Examples of zero force connectors are shown in U.S. Pat. Nos. 3,963,317 issued June 15, 1976 to Eigenbrode, 4,047,782 issued Sept. 13, 1977 to M. L. Yaeger and 4,072,379 issued Feb. 7, 1978 to G. L. Towne et al. These patents are characterized by providing facilities for spreading a pair of rows of spring contacts to permit the insertion therebetween of a plug-like connector. The spreading is usually accomplished by interposing a camming member between a pair of rows of spring-like contact fingers. The camming member is rotated or shifted to spread the rows of spring contact pairs to permit the insertion of the plug-like connector, whereafter the camming member is again actuated to permit the spring contact pairs to flex into engagement with the plug contact elements.

Another type of zero insertion force connector arrangement is disclosed in U.S. Pat. No. 4,068,170 issued Jan. 10, 1978 to G. A. Chayka et al., wherein two banks of contact pairs are mounted on camming elements which are actuated to open the contact pairs to each bank. Two rows of leads depending from electronic components are inserted between the open banks of contact pairs, whereafter the camming members are turned to simultaneously close both banks of contact pairs against the depending leads. U.S. Pat. No. 3,670,288 issued June 13, 1972 to W. R. Evans shows a plurality of pretwisted parallel contact elements which are untwisted to provide spaces to receive terminals extending from a printed circuit board. Following insertion of the terminals, the contacts are returned to the pretwisted position to firmly engage the printed circuit board terminals.

SUMMARY OF THE INVENTION

This invention contemplates, among other things, a connector made up of socket halves that are moved together and apart by a pair of left and right-hand screw sections engaging threads formed on the ends of the socket-like connector halves. More particularly, a frame is provided to support a pair of spaced parallel screws which is made up of a number of contiguous left and right-hand threaded sections. Each pair or set of right-hand and left-hand thread sections threadably engages and supports a pair of connector socket halves which mount aligned contact elements.

When the screws are turned in a first direction, the conductor halves are spread apart to receive a number of tiers of plug-like connectors. The screws are then turned in an opposite direction to move the contact halves together to bring the contact elements into engagement with spring-like contacts formed on the connector plugs.

BRIEF DESCRIPTION OF THE DRAWING

Other features and advantages of the invention will appear upon consideration of the following description of the drawings, wherein.

DETAILED DESCRIPTION

Figure 1:
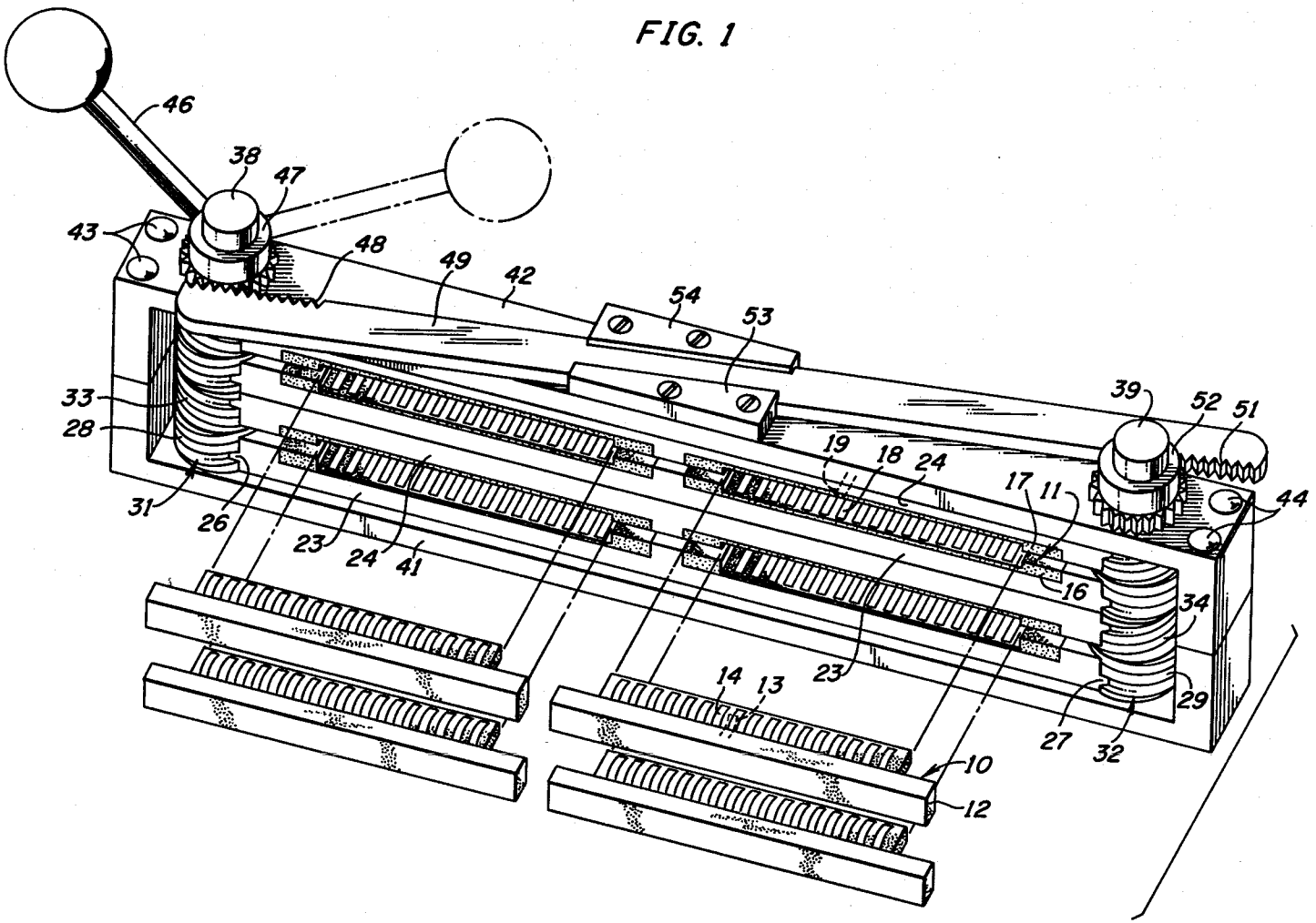
FIG. 1 is a perspective view of a multi-socket zero insertion force connector embodying the principles of the present invention.
Figure 2:
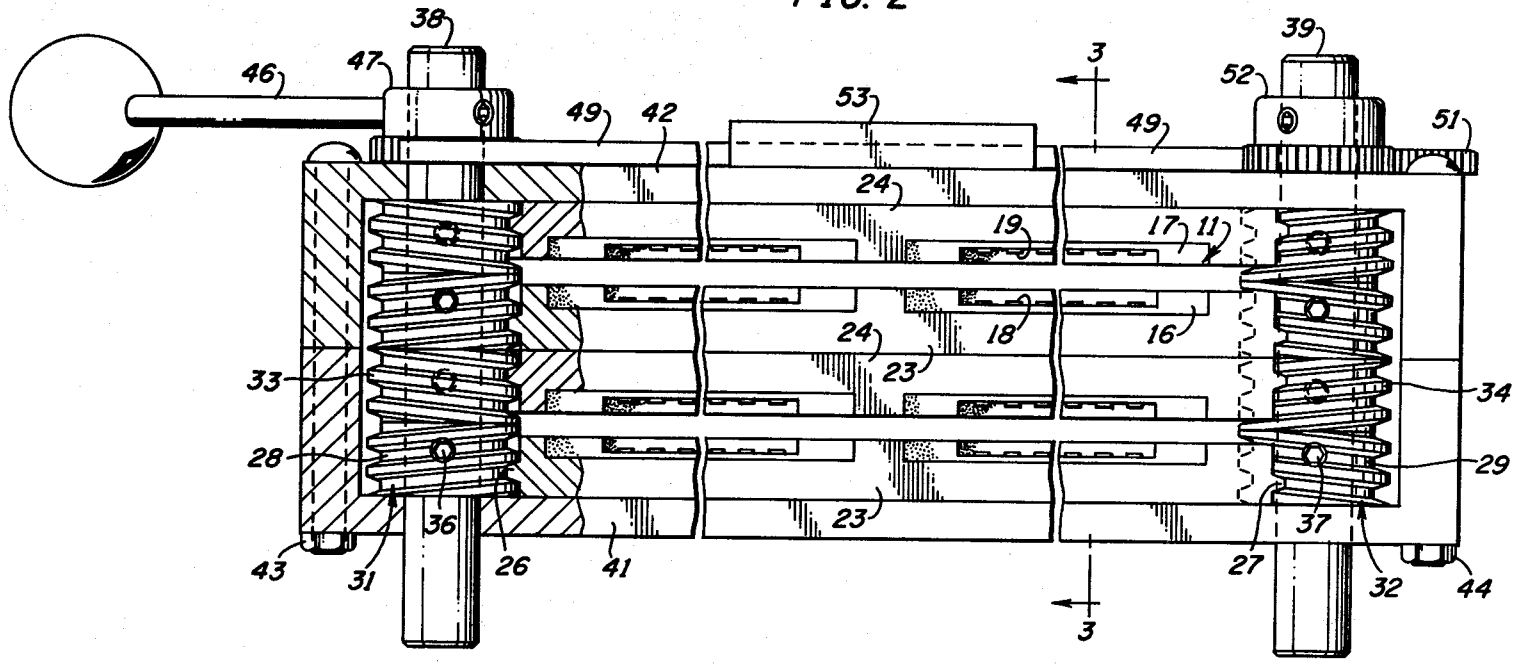
FIG. 2 is a front elevational view, partially cut away, of the zero insertion force connector particularly showing the construction of a pair of screws for simultaneously moving a number of socket-like connector halves.

Referring to FIG. 1, there is shown a bank of four plug connectors 10 arrayed in two tiers that are to be assembled with a bank of four socket or jack-like connectors 11. In one application of the invention, the plug connectors 10 can be moved within the jack connectors 11 when the plug connectors are formed on a replaceable circuit, such as a printed circuit board. In other applications of the invention, the plug connectors 10 may be wired to stationary circuit packs, such as in a telephone switching frame, and the jack connectors 11 moved onto the plug connectors for purposes of running various electrical tests.

Figure 3:
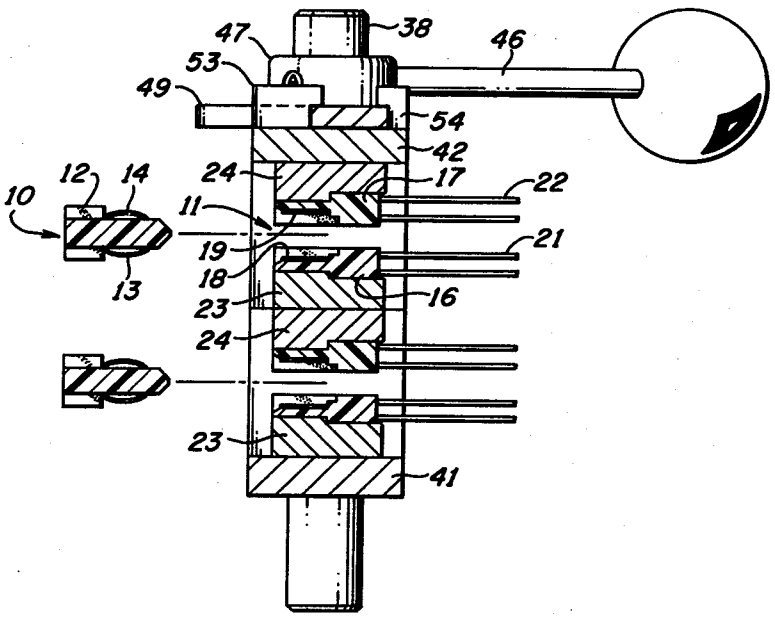
FIG. 3 is a cross-sectional view taken along line 3—3 of FIG. 2 showing two tiers of plugs that may be inserted between the connector halves and then simultaneously engaged by the contact elements on the connector halves.

The plug connector 10 may be constructed of a dielectric plastic base 12 to serve as a mount for pairs of opposed contact springs 13 and 14 which are plated with a thin layer of gold or other precious metal. The jack connectors 11 each comprise a pair of recessed dielectric plastic flat blocks 16 and 17 (see also FIG. 3) for supporting aligned pairs of flat contact fingers or slightly bowed springs 18 and 19 which are connected to parallel rows of terminals 21 and 22 connected to external circuitry, such as a test set. The contact fingers may also be plated with a thin layer of gold or other precious metal.

Figure 4:
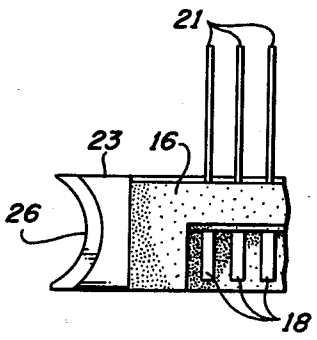
FIG. 4 is a partial top view of one of the connector halves particularly showing an arcuate thread section formed on one end.

The connector half blocks 16 and 17 are supported in pairs of recessed, bar mounts 23 and 24 constructed of beryllium copper or molded phenolic plastic. The lower illustrated bar mount 23 is formed with threaded arcuate sectors 26 and 27 (see also FIG. 4) at opposite ends thereof to mesh with screw sections 28 and 29 of screw sets 31 and 32. Arcuate sector 26 may be formed with a right-hand standard acme thread to mesh with a right-hand thread formed on the screw section 28. The arcuate sector 27 is formed with a left-handed standard acme thread to mesh with the left-hand standard acme thread formed on screw section 29.

The left end of upper bar mount 24 of the lower pair may be formed with a left-hand standard acme thread to mesh with the left-hand standard acme thread formed on a screw section 33 of screw set 31; while the right-hand end of mount 24 is formed with a right-hand standard acme thread to mesh with a right-hand standard acme thread formed on a screw section 34 of screw set 32. The screw sections 28, 29, 33 and 34 are individual units that are pinned by set screws 36 and 37 to parallel actuator rods 38 and 39 which are journalled within suitable bearings mounted in frame halves 41 and 42. It is to be understood that the upper pair of mounts 23 and 24 are provided with identical threaded sectors to cooperate with screw sets which are identical to the screw sets 31 and 32.

The frame halves 41 and 42 are secured together by bolts 43 and 44 to form a generally rectangular, open frame for supporting the banks of jack or socket connectors. Secured to the upper end of the rod 38 and radially extending therefrom is an acutator handle 46 for rotating the rod 38. The rod 38 is also keyed to a pinion gear 47 that meshes with teeth 48 of a rack 49. The rack 49 is provided with a second set of teeth 51 which mesh with the teeth of a pinion 52 mounted on and secured to the rod 39. The rack is guided for rectilinear movement by a pair of guide members 53 and 54.

Assume that the multi-tiered jack connector is to be used for the purpose of interconnecting a test set to a bank of a plurality of tiers of plugs 10 projecting from a fixed circuit complex. The handle 46 is pivoted to the postion shown so that the screw sets 31 and 32 hold the jack connector mounts 23 and 24 in the open position as illustrated in the drawings. The rectangular frame 41–42 is moved to position the spring terminals 18 and 19 of the respective jack connectors over the contact springs 13 and 14 of the plugs 10. The handle 46 is moved to the dashed line position illustrated in FIG. 1, whereupon the screw sets 31 and 32 rotate to move the mounts 23 and 24 toward each other to move the contact fingers 18 and 19 into firm engagement with the contact springs 13 and 14.

It will be readily appreciated that the number of mounts 23 and 24 can be increased with the addition of additional screw sets 31 and 32 so that vast arrays of plugs may be simultaneously engaged with a mininum amount of sliding force, hence, effectively eliminating erosion of the thin precious metal contact surfaces provided on the contact elements. With the described zero force connector, the contact elements 18 and 19 of jack connectors 11 move normal to the engaged surfaces of the bank of plug contact springs 13 and 14, thus eliminating sliding forces, and hence, minimizing the physical forces required to effectuate good electrical contacts between the engaged contact elements.

What is claimed is:

1. A zero force connector for engaging a multi-tiered bank of plugs each having pairs of opposed terminal contact elements mounted thereon, which comprises:

a plurality of pairs of associated spaced bar-like connector halves, each having a series of contact elements arrayed in a tier facing a tier of the contact elements on the other connector half; and means for simultaneously moving each connector half of each pair of connector halves toward and away from the associated connector half of each pair to engage and disengage the connector contact elements with the terminal contact elements on each tier of a bank of plugs positioned between the connector halves.

2. A zero force connector, which comprises:

a rectangular frame having end walls and side walls;

a pair of parallel, spaced screws, each of which is rotatably mounted at opposite ends to extend through both side walls of said frame, each screw having contiguous right and left-hand threads;

a pair of elongated support bars positioned in said frame between said screws and each having a pair of arcuate screw thread sections formed on the respective ends of the bars to mesh with the respective right and left-hand threaded sections of said screws; and contact elements mounted on the facing sections of said bars, each contact element on one bar being aligned with and spaced from a contact element on the other bar.

3. A zero force connector for engaging a plug having a plurality of contacts, which comprises:

a frame having an opening extending therethrough;

a pair of parallel screws mounted in said frame for rotation at opposite ends of said opening, each of said screws being made up of a contiguous set of left and right-hand thread sections;

a pair of bars extending between said parallel screws and each bar having threaded end sectors meshing with the threads of a pair of screw sets;

means for simultaneously rotating said screws to simultaneously open and close said pair of bars;

a pair of insulative blocks mounted on said bars for movement therewith; and a series of contact elements mounted on each of said insulative blocks and positioned to engage contact elements on a plug inserted between said blocks.

4. A zero force connector for a bank of a plurality of tiers of pairs of terminal contacts, which comprises:

a frame having an opening therethrough for receiving said bank of tiers of terminal contacts;

a pair of spaced screw means mounted to transcend said opening at opposite ends thereof, each of said screw means including a plurality of sets of contiguous left and right-hand screw sections;

a plurality of pairs of support bars extending between said pair of screw means and each of said bars having threaded end sectors meshing with individual screw sections on the spaced screw means, each of said pair of bars being supported by said screw sections in spaced apart relation to receive a tier of pairs of terminal contacts;

contact elements attached to said bars for movement with said bars toward each other to engage with the terminal contacts of the bank of terminal contacts when said frame is positioned over the bank of terminal contacts; and means for turning said screw means to simultaneously move each of said pairs of support bars toward each other to engage the contact elements with the bank of terminal contacts.

5. A zero force connector as defined in claim 4, which includes:

opposed pairs of insulating mounts secured respectively to said pairs of support bars for mounting and attaching said contact elements to said bars.

6. A zero force connector as defined in claim 4, wherein said turning means includes:

a pair of gears attached respectively to first ends of said screw means; and a rack having teeth meshing with said gears to transmit movement of one gear to the other gear to simultaneously turn both of said screw means.

* * * * *